US009378631B2

(12) United States Patent
Dempsey

(10) Patent No.: US 9,378,631 B2
(45) Date of Patent: Jun. 28, 2016

(54) SOCCER GOAL SECUREMENT MONITOR

(71) Applicant: GOAL ALERT LLC, Chicago, IL (US)

(72) Inventor: Gregory Dempsey, Glen Ellyn, IL (US)

(73) Assignee: GOAL ALERT LLC, Chicago, IL (US)

( * ) Notice: Subject to any disclaimer, the term of this patent is extended or adjusted under 35 U.S.C. 154(b) by 470 days.

(21) Appl. No.: 14/028,706

(22) Filed: Sep. 17, 2013

(65) Prior Publication Data

US 2014/0014025 A1 Jan. 16, 2014

Related U.S. Application Data

(63) Continuation of application No. 13/567,434, filed on Aug. 6, 2012, now Pat. No. 8,534,219, which is a continuation of application No. 12/621,230, filed on Nov. 18, 2009, now Pat. No. 8,234,995.

(60) Provisional application No. 61/122,471, filed on Dec. 15, 2008.

(51) Int. Cl.

| | |
|---|---|
| ***G08B 5/02*** | (2006.01) |
| ***A63B 63/00*** | (2006.01) |
| *A63B 71/00* | (2006.01) |

(52) U.S. Cl.

CPC ..... *G08B 5/02* (2013.01); *A63B 63/004* (2013.01); *A63B 71/0054* (2013.01)

(58) Field of Classification Search

CPC .. A63B 63/00; A63B 63/004; A63B 71/0054; A63B 71/08; G08B 5/00; G08B 5/02; G08B 21/00; G08B 21/02

USPC ..... 116/1, 67 R, 77, 82, 98, 200, 209, 222, 116/303, 313; 473/478

See application file for complete search history.

(56) References Cited

U.S. PATENT DOCUMENTS

| | | | | | |
|---|---|---|---|---|---|
| 970,565 | A * | 9/1910 | Smith | G08B 13/126 | 116/98 |
| 1,063,703 | A * | 6/1913 | Levorsen | G08B 13/126 | 116/98 |
| 2,784,692 | A * | 3/1957 | Ballesteros | E01F 9/0118 | 116/28 R |
| 2,860,595 | A * | 11/1958 | Androsiglio | G01B 13/1472 | 116/98 |
| 3,100,472 | A * | 8/1963 | Jackson | A63B 5/00 | 116/200 |
| 3,500,791 | A * | 3/1970 | Jackson | A63B 71/0605 | 116/313 |
| 3,641,693 | A * | 2/1972 | Pinnow | A01K 97/01 | 116/173 |
| 3,786,778 | A * | 1/1974 | Palmer | G09F 17/00 | 116/173 |
| 3,837,109 | A * | 9/1974 | DeJulio | A01K 97/11 | 43/15 |
| 3,897,646 | A * | 8/1975 | Sheets | A01K 97/11 | 43/15 |
| 3,911,857 | A * | 10/1975 | Manuel | A63B 69/16 | 116/313 |

(Continued)

*Primary Examiner* — R. A. Smith

(74) *Attorney, Agent, or Firm* — Factor Intellectual Property Law Group, Ltd.

(57) ABSTRACT

A device indicates a ready and/or upset condition of a ground supported goal such as a soccer goal that has at least one bar that lies in contact with the ground. An indicator arm is movable relative to the contact arm between a ready position and an upset position. A contact arm cooperates with. A biasing element biases the indicator arm to the upset position. When the bar of the goal is no longer in contact with the ground the indicator arm moves from the ready position to the upset position.

20 Claims, 7 Drawing Sheets

(56) References Cited

U.S. PATENT DOCUMENTS

| | | | | | |
|---|---|---|---|---|---|
| 4,188,742 | A * | 2/1980 | Oulman | A01K 97/11 | 43/15 |
| 4,316,575 | A * | 2/1982 | VanDarwarka | A47G 29/121 | 232/34 |
| 4,969,398 | A * | 11/1990 | Lundwall | F41H 11/12 | 102/293 |
| 5,657,716 | A * | 8/1997 | Beasley | B65G 69/2876 | 116/215 |
| 6,082,697 | A * | 7/2000 | Grunfeld | A63B 3/004 | 248/156 |
| 6,962,126 | B1 * | 11/2005 | Payson | B63B 15/00 | 114/253 |
| 7,341,531 | B2 * | 3/2008 | Caruso | A63B 71/023 | 273/400 |
| 7,527,569 | B2 * | 5/2009 | Rogers | A63B 63/004 | 473/478 |
| 8,234,995 | B2 * | 8/2012 | Dempsey | A63B 63/004 | 116/303 |
| 8,534,219 | B2 * | 9/2013 | Dempsey | A63B 63/004 | 116/303 |
| 2006/0202426 | A1 * | 9/2006 | Tennett | A63B 63/00 | 273/407 |
| 2008/0207361 | A1 * | 8/2008 | Rogers | A63B 63/004 | 473/478 |
| 2011/0098139 | A1 * | 4/2011 | Query, Jr. | A63B 63/004 | 473/478 |

* cited by examiner

SOCCER GOAL SECUREMENT MONITOR

CROSS-REFERENCE TO RELATED APPLICATION DATA

This application is a continuation of co-pending U.S. patent application Ser. No. 13/567,434 filed on Aug. 6, 2012, which in turn is a continuation of U.S. patent application Ser. No. 12/621,230 filed on Nov. 18, 2009, now U.S. Pat. No. 8,234,995 issued on Aug. 7, 2012, which claims the benefit of priority of Provisional U.S. Patent Application Ser. No. 61/122,471, filed Dec. 15, 2008, entitled, "GOAL TO GROUND MONITOR", and all of which are incorporated herein by reference.

BACKGROUND OF THE INVENTION

The present invention relates to a device for monitoring the present and past ground contact of moveable sport goals. In particular the invention relates a device to monitor the ground contact of soccer goals and to provide a visual indication of ground contact status of the goal.

Soccer is one of, and perhaps the most popular sport in the world. In some instances, soccer goals are fixed, or set securely (permanently or semi-permanently) into the ground. In other instances, soccer fields can be shared (e.g., also used as lacrosse fields), and as such the goals are moveable.

Typically, the goals are staked or anchored into the ground to secure the goals in place. However, at times, due to various reasons, the goals become un-staked and loose. This can cause a hazardous condition.

There is a danger of goals tipping over. Such tipping has resulted in numerous serious injuries, often of young children, with some victims as young as 3 and 4 years of age. Indeed, it is estimated that tipping over of goals results in between 90 and 200 serious injuries annually, and that such injuries can require hospitalization. Many of these injuries are to the brain and spine.

By its nature the goal is counter weighted by the base of the goal with most of its weight to the rear of the goal. However with some degree of force the goal can tip over. The force required to overturn a goal can be quite low. There are many reported instances where a goal has been overturned by wind alone. A small child climbing on the net or crossbar may also be sufficient to reduce the stability of the goal. Because of the weight of these soccer goals, averaging between about 150-500 pounds, the results of a goal striking a person can be devastating.

Maintaining these goals anchored to the ground would seem a manageable if not straightforward task. However, due to the sheer number of goals and the multi-usage of the fields, as well as other factors including, for example, changing soil conditions due to, for example, excessive rain or drought, this has proven a much more challenging and elusive task.

Accordingly, there is a need for a monitoring system that monitors change in a resting state of a ground resting goal, such as a soccer goal. Desirably, such a monitoring system is easily installed. More desirably, such a monitoring indicates minor movement of the goal from the safe or resting position and maintains such indication until reset. More desirably still, such a system provides ready visual indication of such an upset condition.

BRIEF SUMMARY OF THE INVENTION

A goal to ground monitor or indicator device indicates a ready and/or upset condition of a ground supported goal, such as a soccer goal, that has at least one bar that lies in contact with the ground. The monitor includes a base plate, a contact arm mounted to the base plate and movable relative to the base plate and an indicator arm mounted to the base plate for cooperation with the contact arm.

The contact arm and a portion of the base plate are configured for contact with the bar. That is, the bar overlies portions of the contact arm and base plate.

The indicator arm is mounted to the base plate for cooperation with the contact arm. The indicator arm is movable relative to the contact arm between a ready position and an upset position. The indicator arm is positioned such that a portion of the contact arm cooperates with a portion of the indicator arm to temporarily maintain the indicator arm in the ready position.

A biasing element, such as a spring, biases the indicator arm to the upset position.

The contact arm, resting in the base plate, cooperates with the indicator arm against the biasing element to maintain the indicator arm in the ready position when the bar overlies the contact arm. When the bar is moved from the contact arm, the spring exerts a force to move the indicator arm from the ready position, which moves the contact arm from the base plate to disengage the indicator arm and to continue moving the indicator arm to the upset position.

In an exemplary monitor, the contact arm and the indicator arm are pivotally mounted to the base plate. The pivot axis of the contact arm and the pivot axis of the indicator arm can be non-parallel, e.g., generally normal to one another or, alternately, they can be parallel to one another.

In one embodiment, the indicator arm includes a movable, biased finger configured to cooperate with the contact arm to maintain the indicator arm in the ready position. The contact arm includes a recess in a lower surface thereof such that in the ready position, the finger resides in the recess. A set lock can be provided on the contact arm that is movable between a first position in which the indicator arm is movable to the ready position with the contact arm resting in the base plate and a second position in which the set lock prevents movement of the indicator arm from the upset position into the ready position.

Indicator flag arms can be mounted to the indicator arm. The flag arms include a ready position flag arm and an upset position flag arm. The ready position flag arm can be green and the upset position flag arm can be red to provide readily visually perceptible indication whether an upset condition has occurred. The flag arms can include flags mounted thereto.

In an alternate embodiment, the contact arm and indicator arm include interfering portions configured to cooperate with one another. In this embodiment, in the ready position, the contact arm interfering portion overlies the indicator arm interfering portion to maintain the indicator arm in the ready position. After movement to the upset position, the contact arm interfering portion prevents resetting of the indicator arm without upward pivoting of the contact arm.

The base plate can be configured with one or more openings for securing the monitor device to the ground, such as by staking A cable and lock can be provided to present movement, vandalism or theft.

In still another alternate embodiment, a ground supported goal has an indicator device for indicating a ready and/or upset condition of the goal mounted directly to it. The goal includes at least one ground bar resting on the ground. The contact arm is operably mounted to the goal and is movable relative to the ground bar resting on the ground.

The indicator arm is operably mounted to the goal for cooperation with the contact arm. The indicator arm is movable relative to the contact arm between the ready position and the upset position. The indicator arm is positioned such that a portion of the contact arm cooperates with a portion of the indicator arm to temporarily maintain the indicator arm in the ready position.

A biasing element biases the indicator arm to the upset position. As such, the contact arm cooperates with the indicator arm against the biasing element to maintain the indicator arm in the ready position when the ground bar is on the ground. When the ground bar is moved off of the ground, the biasing element exerts a force to move the indicator arm from the ready position. This moves the contact arm to disengage the indicator arm and to continue moving the indicator arm to the upset position.

In a preferred alternate embodiment, the contact arm is pivotally mounted to the ground bar and the indicator arm is mounted to the ground bar and cooperates with the contact arm to maintain the indicator arm in the ready position.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and photographs and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 1:
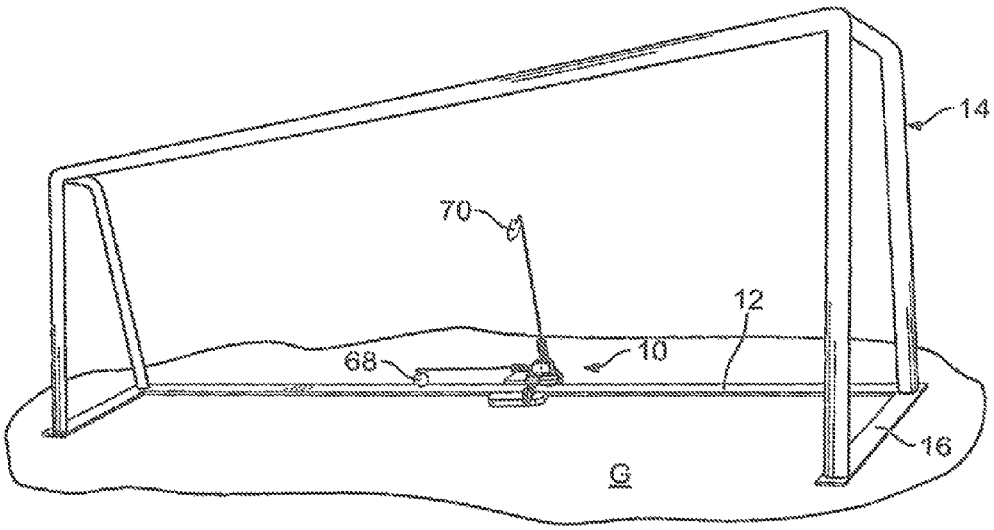
FIG. 1 is a front perspective view of a goal, such as a soccer goal, having a goal to ground monitor located at the rear ground bar or shoe, embodying the principles of the present invention.
Figure 2:
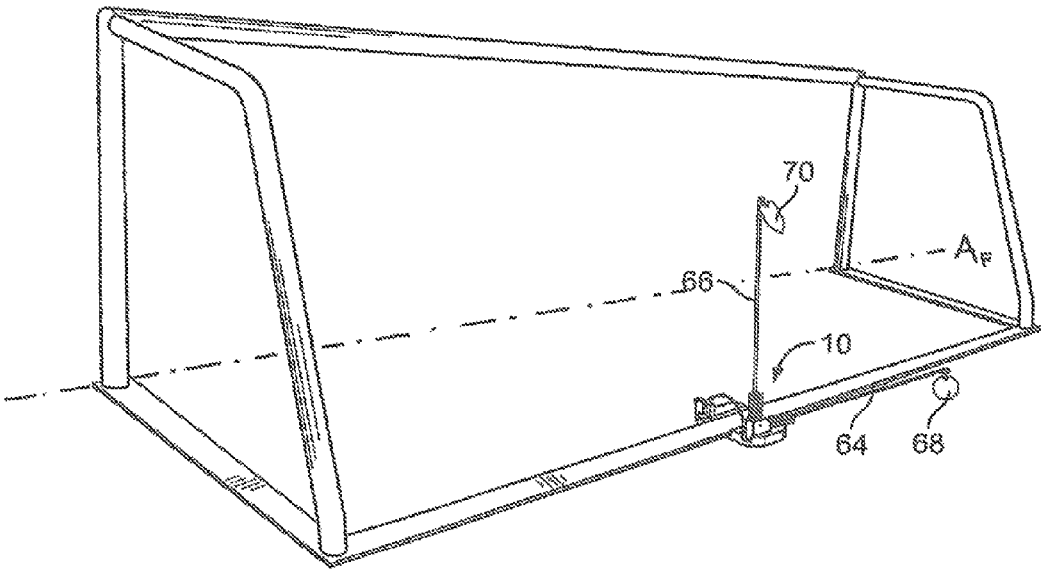
FIG. 2 is a rear perspective view of the goal and the monitor.
Figure 3:
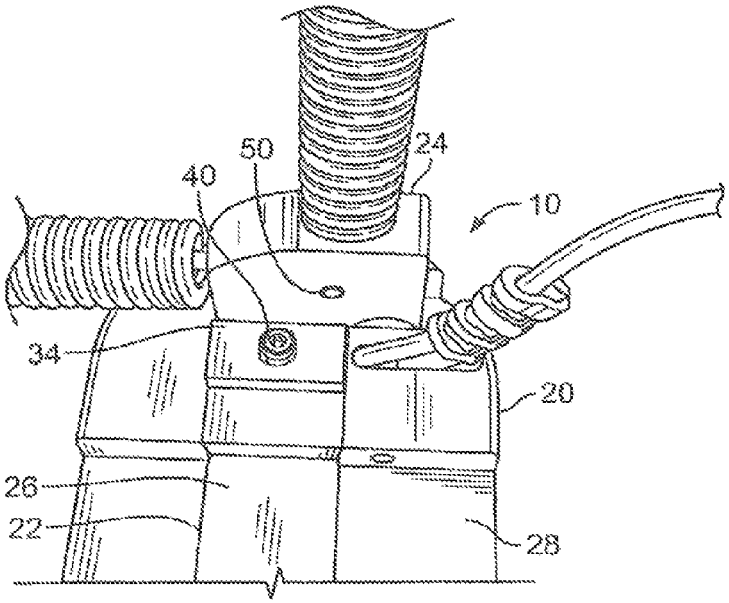
FIG. 3 is a partial top view of the goal to ground monitor showing the indicator arm in the ready or seated position.
Figure 4:
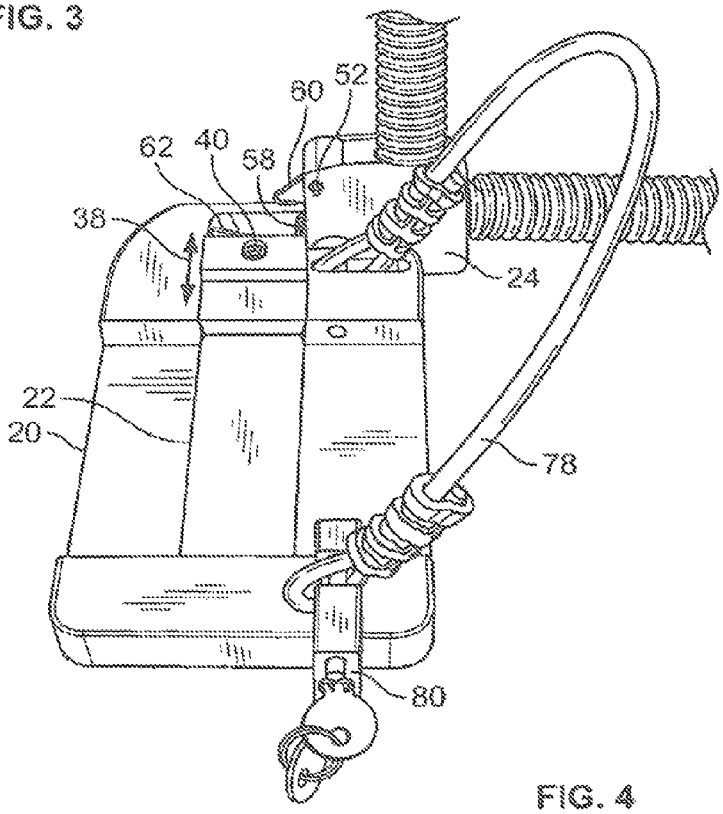
FIG. 4 is a partial top view of the goal to ground monitor showing the indicator arm in the upset or unseated position.
Figure 5:
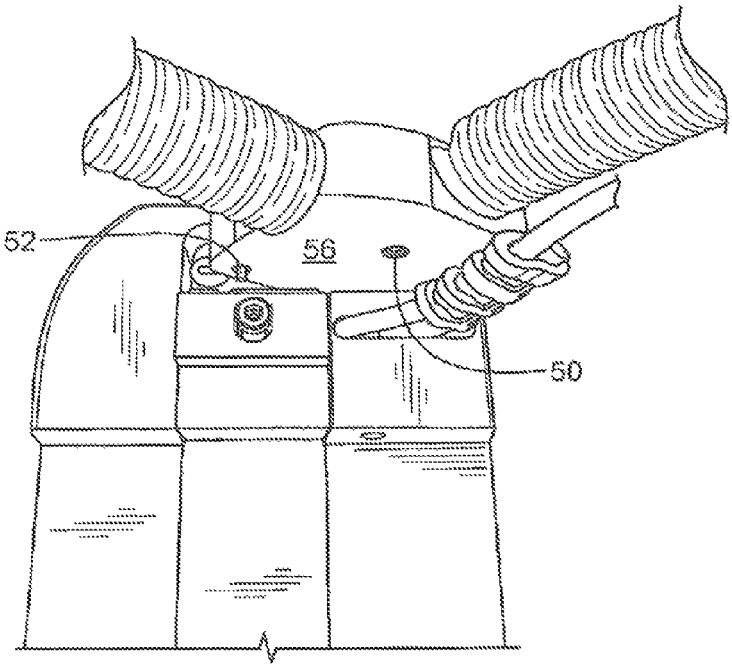
FIG. 5 is a partial top view similar to FIG. 4 with the indicator arm pivoting from the ready position to the upset position.
Figure 6:
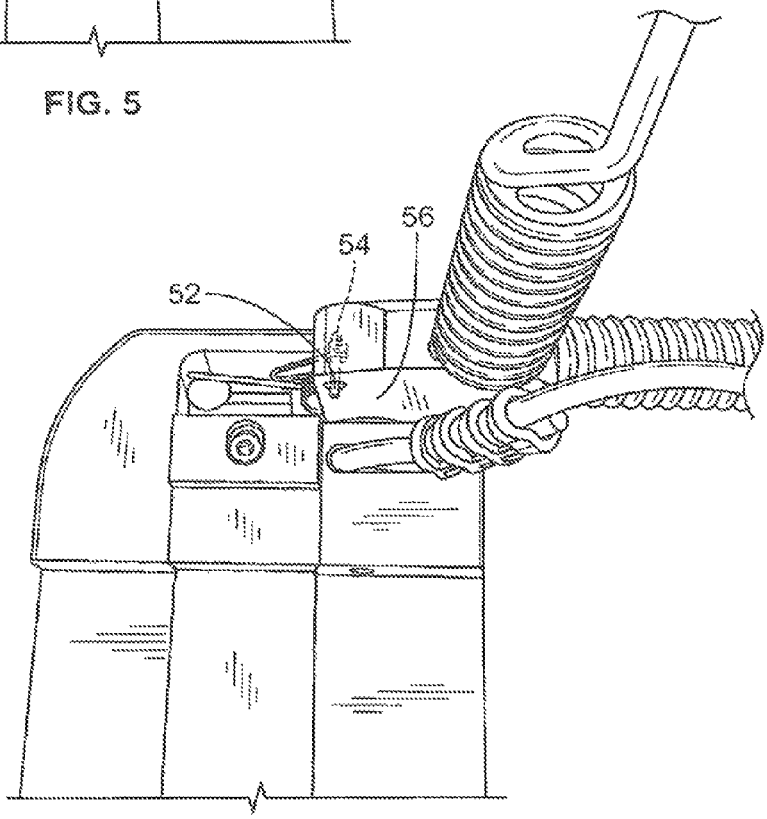
FIG. 6 is a partial top view similar to FIG. 5 with the indicator arm pivoted to the upset position.
Figure 7:
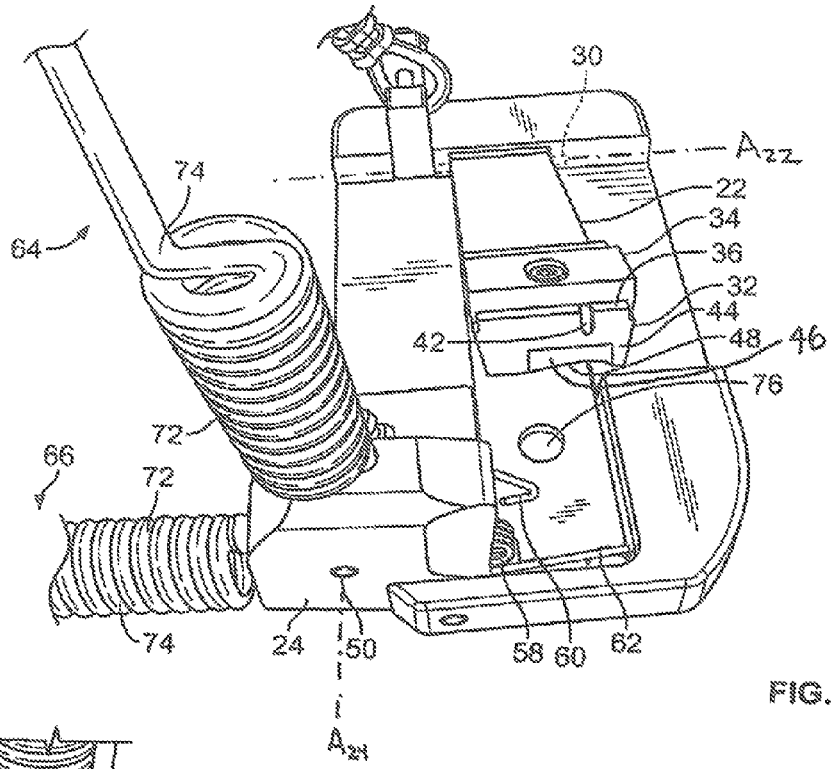
FIG. 7 is a top rear perspective view illustrating the contact arm pivoted upwardly from the base plate and the indicator arm pivoted to the upset position.
Figure 8:
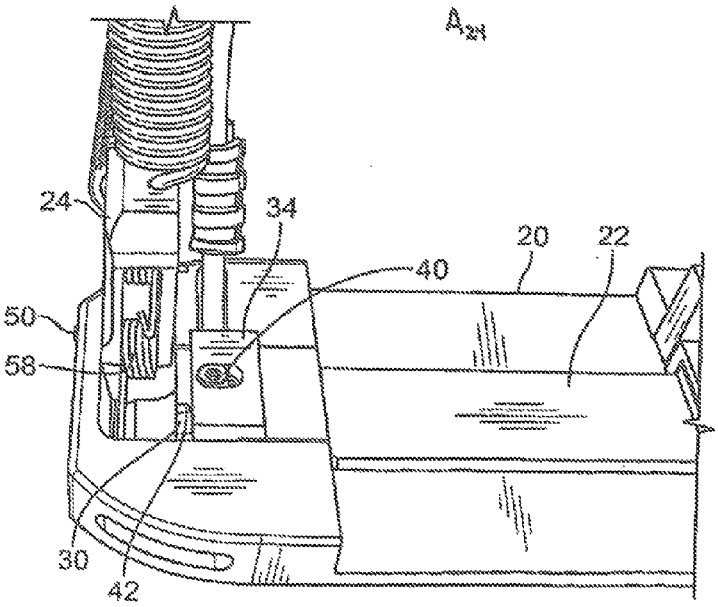
FIG. 8 is a side view of the goal to ground monitor shown with the indicator arm in the upset position for ease of illustration.
Figure 9:
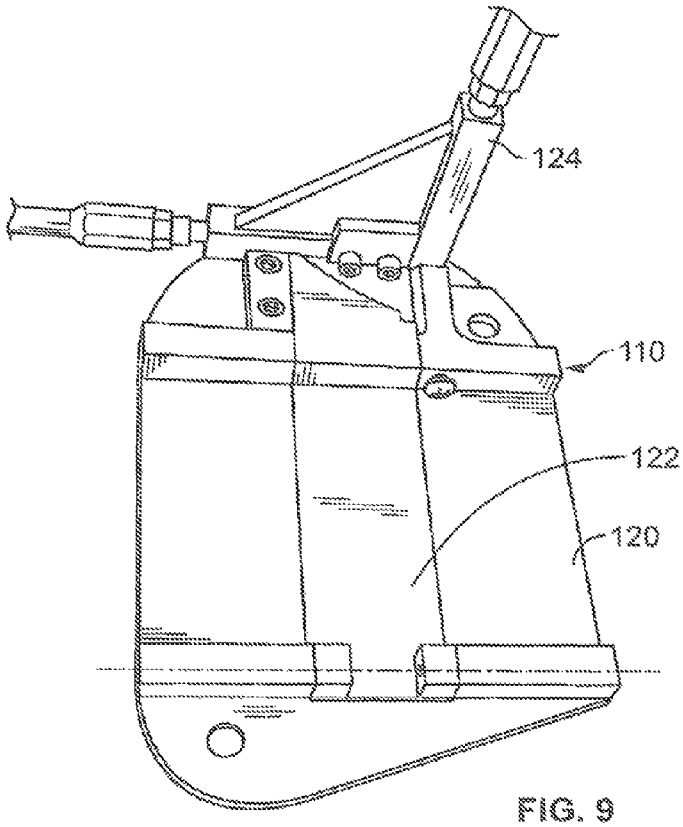
FIG. 9 is a front perspective view of an alternate embodiment of a goal to ground monitor embodying the principles of the present invention.
Figure 10:
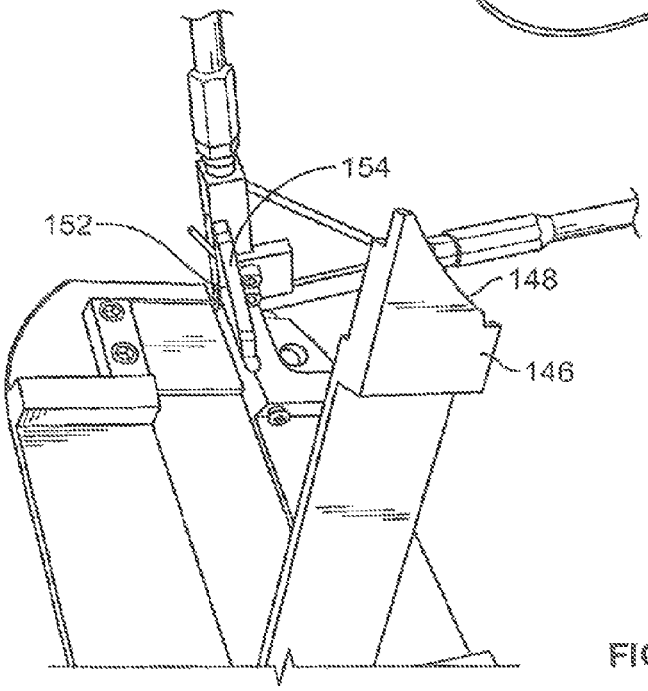
FIG. 10 is a front perspective view of the alternate embodiment with the contact arm pivoted upwardly from the base plate and the indicator arm pivoting from the ready position to the upset position.
Figure 11:
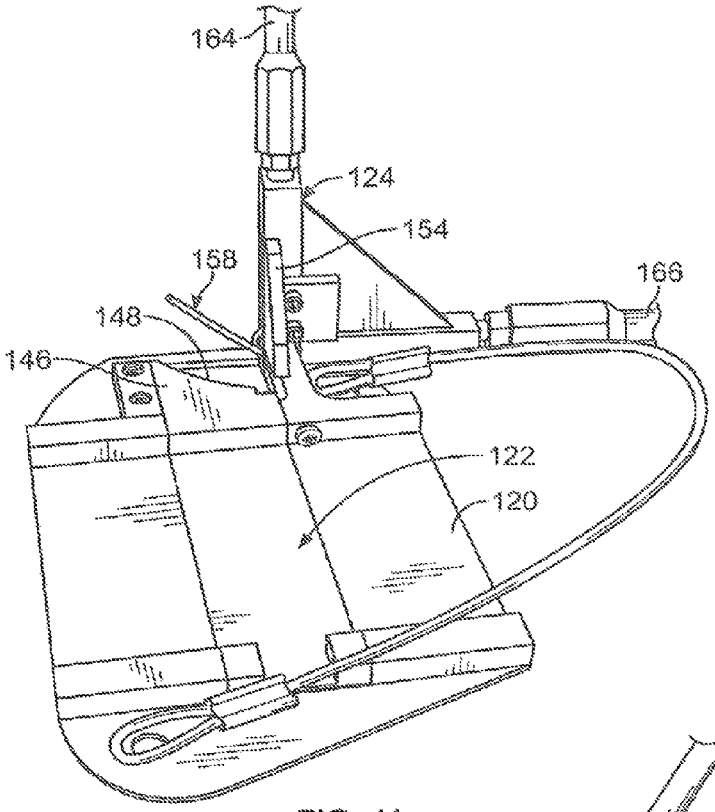
FIG. 11 is a front perspective view similar to FIG. 9, but showing the indicator arm fully pivoted to the upset position.
Figure 12:
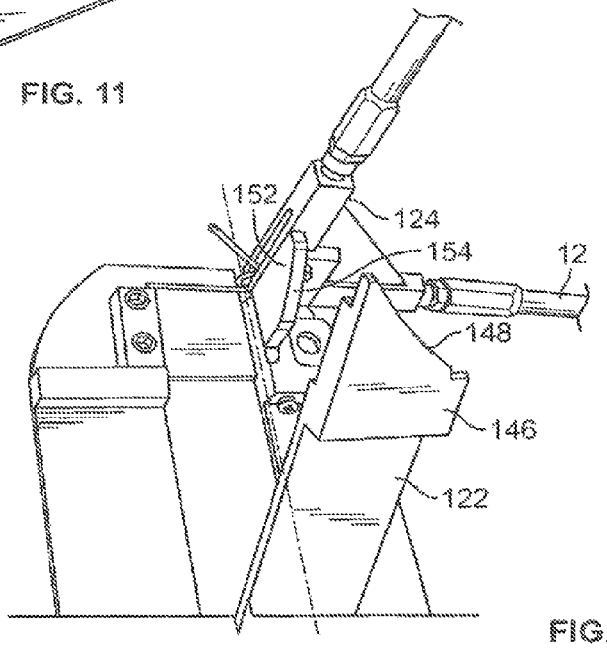
FIG. 12 is a front perspective showing the contact arm pivoted upwardly from the base plate and the indicator arm pivoted to the upset position.

Referring to the figures and in particular to FIGS. 1 and 2, there is shown an embodiment of a goal to ground monitor 10 embodying the principles of the present invention. The monitor 10 is shown at the rear ground bar or rear ground shoe 12 (collectively, rear ground bar) of a soccer goal 14. It will be appreciated that the goal to ground monitor 10 can be located along the ground bar or ground shoe 16 (collectively, ground bar), which is the bar that rests on the ground G and extends along the side of the goal 14, rather than along the rear of the goal. For purposes of the present disclosure, reference to ground bar or rear ground bar is to any bar that forms part of the goal 14 structure, and rests on the ground G, whether such bar is along a side or along the rear of the goal 14.

The monitor device 10 includes a base plate 20 that rests on the ground G, under the ground bar 12, 16. Preferably, the monitoring device 10 is positioned under the rear ground bar 12. If it is positioned at the ground bar 16 (that is along a side of the goal 14), it is preferably located under a rear-most part of the bar 16. This may be the case in those instances where there may not be a rear bar 12 or when positioning the monitor 10 at the rear bar 12 is not ideal. In that goals will typically tip by rotating about the front corners F of the goal 14, it is preferable to locate the monitor 10 as far from the pivot point (axis $A_F$) as is reasonably possible, in that the farthest point moves the greatest distance when the goal 12 is tipped.

Referring to FIGS. 3-8, the base plate 20 has mounted to it two pivoting elements 22, 24. The first element, or bar contact arm 22, is pivotally mounted to the base plate 20 and, along with the plate 20 has a recess 26, 28 formed therein, in which the ground bar 12 rests. The bar contact arm 22 pivots about an axis $A_{22}$ that is generally parallel to the ground bar 12. In a present device 10, the bar contact arm 22 pivots about a hinge pin 30 (see generally FIG. 7) that mounts the arm 22 to the base plate 20. The contact arm 22 can be chamfered or tapered as at 32 to preclude binding of the arm 22 and to permit the arm 22 to freely pivot out of the resting or ready position (out of the base plate 20).

The contact arm 22 includes a set lock 34. The set lock 34 is positioned on an upper surface 36 of the contact arm 22 and is slidable longitudinally (as indicated by the arrow at 38) along the contact arm 22. The set lock 34 is lockable (or securable) in the extended or retracted position. The set lock 34 can include a shoulder bolt 40 or like fastener to facilitate securing it in the extended position. The contact arm 22 includes a ramped notch 42 that extends into the front face 44 and to the top surface 36 of the contact arm 22. The set lock 34 is positioned over, e.g., covers, the notch 42 when the set lock 34 is in the extended position and uncovers the notch 42 when in the retracted position. A recess 46 is formed in a lower surface 48 of the contact arm 22.

The second or indicator arm 24 is pivotally mounted to the base plate 20, about a pivot axis $A_{24}$ that is generally normal (or perpendicular) to the contact arm axis $A_{22}$ and the ground bar 12, 16. The pivot 50 (the axis of which is indicated at $A_{24}$) of the indicator arm 24 can be mounted to the base plate 20 slightly offset from the contact arm 22. The indicator arm 24 includes a finger 52 that extends outwardly to engage the contact arm 22. The finger 52 is spring 54 biased to extend outwardly. Depressing the finger 52 against the bias moves the end of the finger 52 flush with the arm surface 56.

A biasing element 58 is positioned to bias the indicator arm 24 to the upset position. In a present embodiment, the biasing element 58 is a spring that is positioned about the indicator arm pivot 50, carried by the base plate 20 or positioned between the arm 24 and the base plate 20. In a present monitor, the spring 58 is a coil spring and both ends 60, 62 of the spring 58 are positioned to urge the indicator arm 24 to the upset position.

Two flag arms 64, 66 are mounted to the indicator arm 24. The arms 64, 66 can be colored and can include a visual indicator such as a red flag 68 that is oriented upward to indicate the upset position and a green flag 70 that is oriented upward to indicate a ready position. A present monitor 10 includes a red flag 68 having an octagonal shape to indicate the upset condition and a green banner-like flag 70 to indicate the ready condition. In the illustrated monitor 10, the flag arms 64, 66 are formed with spring or resilient base sections 72 and the arms 64, 66 themselves are coated 74, as with a plastic coating, which can also be colored, to enhance durability and visual perception.

The base plate 20 can include openings 76 to permit the monitor 10 to be affixed to the ground G. The monitor 10 can be affixed by use of stakes, coil-like augers, corkscrew-like augers/elements or the like (not shown). The monitor 10 can include locks or locking elements so that the monitor 10 can be locked to the goal 14. As illustrated, one suitable lock is a cable lock 78 that is affixed to the base plate 20 and looped over the ground bar 12, 16 to secure the plate 20 to the ground bar 12, 16, to prevent removal, vandalism or theft of the monitor 10. The cable 78 can be secured to the base pate 20 by a key lock 80.

In use, the contact arm 22 is pivoted up and the indicating arm 24 is pivoted down (to the ready position). The contact arm 22 is then pivoted down into the ready position, with the finger 52 positioned in the recess 46 in the bottom 48 of the contact arm 22. The monitor 10, which is now in the ready position, is positioned beneath the ground bar 12, 16.

It will be appreciated that setting the monitor 10 can be difficult given that it is located beneath the ground bar 12, 16. Accordingly, the set lock 34 permits the monitor 10 to be set or reset without the need to remove the monitor 10 from under the ground bar 12, 16, or even lift the ground bar 12, 16. In this manner, the set lock 34 can be moved to the refracted position which exposes the ramped notch 42. As the indicator arm 24 is pivoted to the ready position, the finger 52 engages the ramped notch 42. In that the finger 52 is biased, as the arm 24 is rotated toward the ready position, the finger 52 is urged inward as it moves along or through the notch 42, to allow the indicator arm 24 to pivot fully. Once the indicator arm 24 passes the point at which the finger 52 is beyond the contact arm 22, that is, once the finger 52 enters the recess 46, the spring 54 bias forces the finger 52 outward and the finger 52 engages the contact arm 22, setting the indicator arm 24 in the ready position. The set lock 34 can then be moved and secured into the extended position by, for example, tightening down the fastener 40.

It will be understood that when the goal to ground monitor 10 is in place under the ground bar (whether it is the rear ground bar 12 or one of the side bars 16), the spring 58 force on the indicator arm 24 induces an upward force on the contact arm 22. However, the weight of the goal 14 maintains the contact arm 22 down on the indicator arm 24 and base plate 20. When, for example, the goal 14 lifts off of the ground G, if the goal 14 pivots forwardly, the spring force from the indicator arm 24 forces the contact arm 22 to pivot upwardly (by engagement of the finger 52 with the contact arm recess 46 edge) so that the finger 52 forces the contact arm 22 to pivot up. As the two arms 22, 24 pivot upwardly and the finger 52 disengages from the recess 46. The indicator arm 24 then pivots by force of the spring 58 to the upset position, indicating that some upset has occurred and that the goal requires attention.

It will be appreciated that the set lock 34 prevents the indicator arm 24 from being rotated back toward the ready position and being "reset" without purposefully moving the set lock 34 from the extended position to the retracted position. Thus, if the indicator arm 24 signals some upset position, there must be some purposeful action taken to reset the arm 24 to the ready position.

An alternate embodiment of the goal to ground monitor 110 is illustrated in FIGS. 9-12. In this embodiment, in order to assure that a goal 14 that has moved into an upset position or condition is properly indicated and checked (by an individual), the indicator arm 124, once moved into the upset position, cannot be rotated back into the resting position without fully resetting the monitor 110. That is, once the indicator arm 124 has pivoted out from under the contact arm 122, in order to reset the monitor, the contact arm 122 must be pivoted upwardly, the indicator arm 124 reset to the ready position, and the contact arm 122 brought back onto the indicator arm 124.

Accordingly, the contact arm 122 and indicator arm 124 include interfering portions that overlap. The contact arm interfering portion 146 prevents the indicator arm 124 (interfering portion 152) from fully seating in the base plate 120 if not properly reset. The interfering portions 146, 152 include curved and/or angle surfaces 148, 154 that cooperate to permit the contact and indicating arms 122, 124 to readily slide along and move past one another when the arms 122, 124 move from the ready to the upset position. The interfering portions 146, 152, however, prevent the indicating arm 124 from merely being pivoted to the ready position, without first lifting (pivoting) the contact arm 122.

Figure 13:
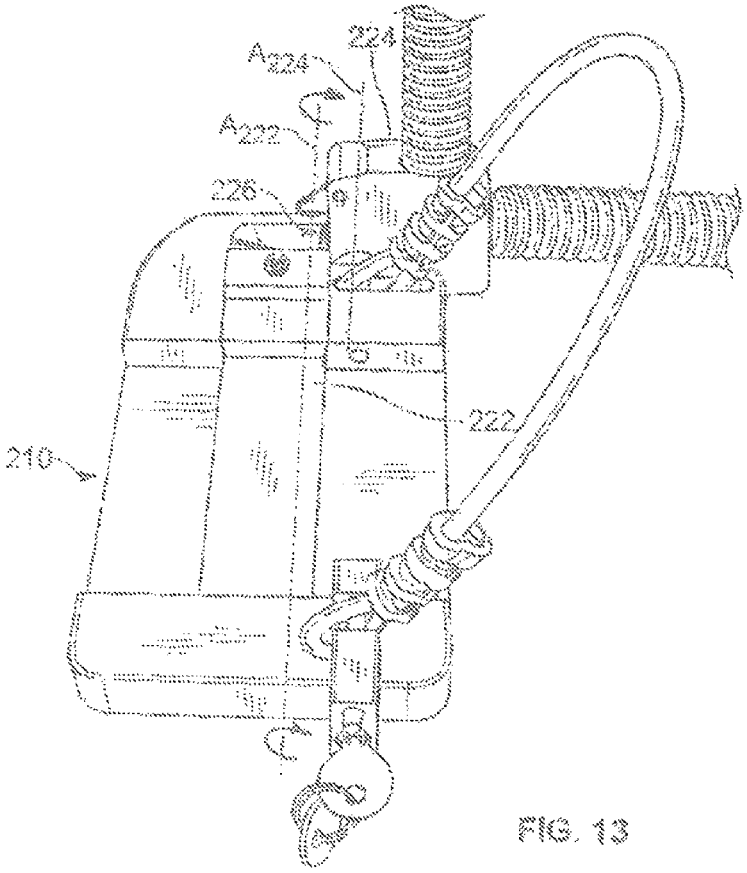
FIG. 13 is a partial top view of another alternate embodiment of the goal to ground monitor showing the contact arm having a parallel pivot axis and with the indicator arm in the upset position.

Still another alternate embodiment of the monitor 210 is illustrated generally in FIG. 13. In this embodiment, the indicator arm 224 pivots as in the prior embodiments (that is about an axis $A_{224}$ that is generally parallel to the ground bar). The contact arm 222, however, also pivots about an axis $A_{222}$ that is parallel to the ground bar (more specifically, parallel to the axis $A_{224}$ about which the indicator arm 224 pivots). The axes $A_{222}$, $A_{224}$ are parallel, but preferably are not collinear; that is, they do not share the same axes. And, the location at which the arms 222, 224, engage one another, as indicated generally at 226, whether it is by a finger and recess (not shown) or cooperating angled/curved surface (not shown), is preferably spaced from (e.g., not collinear with) the indicator arm and contact arm axes $A_{222}$, $A_{224}$. It will be appreciated that such a configuration provides the desired moment, e.g., distance between the engagement point 226 and the rotational axis $A_{224}$, to establish both force and distance to urge the indicator arm 224 to the upset position.

Figure 14:
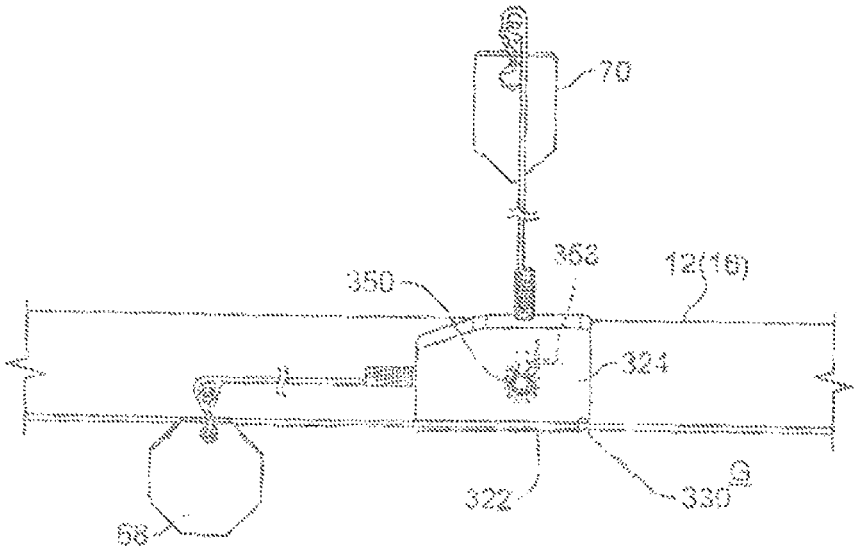
FIG. 14 is an elevational illustration of another alternate embodiment in which the monitor is formed as part of or mounted to the goal.

Still another embodiment 310 is illustrated in FIG. 14 in which the contact arm 322, when the monitor 310 is in the ready position, remains in contact with the ground G and remains in contact with or closely adjacent to the ground bar 12, 16. In this embodiment, the contact arm 322 is biased away from the ground bar 12, 16 by spring 358. The indicator arm 324 is held in the ready position by engagement with the contact arm 322 when the contact arm 322 is "sandwiched" between the ground bar 12, 16 and the ground G.

As the goal 14 lifts from the ground G, the spring 358 bias urges the contact arm 322 away from the ground bar 12, 16. This releases or disengages the indicator arm 324 (disengage the indicator arm 324 from the contact arm 322). As with the prior embodiments 10, 110, 210, in this embodiment 310, the indicator 324 arm is in the ready (green) position when the indicator arm 324 is secured by the contact arm 322 and moves (pivots) to the upset position as it is released from engagement with the contact arm 322. The contact arm 322 and indicator arm 324 can both be mounted to the ground bar 12, 16 by pivot arrangements 330, 350, respectively.

It will be appreciated that the monitor 10, 110, 210, 310 is of a fail-safe design. That it, because the indicator arm 24, 124, 224, 324 fails to the upset position, the monitor 10, 110, 210, 310 will indicate upset even if a true upset condition may not have occurred. Moreover, the upset position can be indicated even if, for example, the spring 58, 158, 358 fails, by weighting the indicator arm 24, 124, 224, 324 or flags 68, 70, or by incorporation of an additional (fail-safe) spring element in the monitor 10, 110, 210, 310 (which the two ends 60, 62 of the spring 58, 158, 358 can be used to effectuate).

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

The invention claimed is:

1. An indicator device for indicating a ready and/or upset condition of a ground supported goal, the ground supported goal having at least one bar that lies in contact with the ground, comprising:

a base plate;

a contact arm mounted to the base plate and movable relative to the base plate, the contact arm and a portion of the base plate configured for contact with the bar;

an indicator arm mounted to the base plate for cooperation with the contact arm, the indicator arm movable relative to the contact arm between a ready position and an upset position, the indicator arm positioned such that a portion of the contact arm cooperates with a portion of the indicator arm to temporarily maintain the indicator arm in the ready position; and a biasing element to bias the indicator arm to the upset position, wherein the contact arm resting in the base plate cooperates with the indicator arm against the biasing element to maintain the indicator arm in the ready position when the bar overlies the contact arm and wherein when the bar is moved from the contact arm, the contact arm disengages the indicator arm allowing the biasing element to move the indicator arm from the ready position to the upset position.

2. The indicator in accordance with claim 1 wherein the contact arm and the indicator arm are pivotally mounted to the base plate.

3. The indicator in accordance with claim 2 wherein a pivot axis of the contact arm and a pivot axis of the indicator arm are non-parallel to one another.

4. The indicator in accordance with claim 3 wherein the contact arm pivot axis and the indicator arm pivot axis are generally normal to one another.

5. The indicator in accordance with claim 4 wherein the contact arm and indicator arm include interfering portions configured to cooperate with one another, and wherein in the ready position, the contact arm interfering portion overlies the indicator arm interfering portion to maintain the indicator arm in the ready position and wherein after movement to the upset position, the contact arm interfering portion prevents resetting of the indicator arm without upward pivoting of the contact arm.

6. The indicator in accordance with claim 2 wherein a pivot axis of the contact arm and a pivot axis of the indicator arm are parallel to one another.

7. The indicator in accordance with claim 2 wherein the indicator arm includes a movable, biased finger configured to cooperate with the contact arm to maintain the indicator arm in the ready position.

8. The indicator in accordance with claim 7 wherein contact arm includes a recess in a lower surface thereof and wherein in the ready position, the biased finger resides in the recess.

9. The indicator in accordance with claim 7 including a set lock movable between a first position and a second position, wherein in the first position, the indicator arm is movable to the ready position with the contact arm resting in the base plate and wherein in the second position, the set lock prevents movement of the indicator arm from the upset position into the ready position.

10. The indicator in accordance with claim 1 wherein the biasing element is a coil spring.

11. The indicator in accordance with claim 1 including an opening in the base plate for securing the indicator device to the ground.

12. The indicator in accordance with claim 1 including indicator flag arms mounted to the indictor arm, the flag arms including a ready position flag arm and an upset position flag arm.

13. The indicator in accordance with claim 12 wherein the ready position flag arm is green and the upset position flag arm is red.

14. The indicator in accordance with claim 13 wherein the flag arms include visually perceptible flags mounted thereto.

15. An indicator device for indicating a ready and/or upset condition of a ground supported goal, the ground supported goal having at least one bar that lies in contact with the ground, comprising:

a base;

at least one movable arm pivotably mounted to the base and configured to indicate a ready position when the bar is resting on the indicator device and configured to indicate an upset position following movement of the bar off of the indicator device;

indicator flags operably mounted to the moveable arm to provide visually perceptible indication of the ready position and the upset position; and, a biasing element for changing the visually perceptible indication from the ready position to the upset position following movement of the bar off of the indicator device.

16. The indicator in accordance with claim 15 wherein the ready position indicator flag and the upset position indicator flags are of different colors.

17. The indicator in accordance with claim 16 wherein the ready position indicator flag is green and the upset position indicator flag is red.

18. The indicator in accordance with claim 15 wherein the indicator flags are mounted to flag arms that are mounted on the moveable arm.

19. The indicator in accordance with claim 18 wherein the flag arms are formed having resilient elements.

20. The indicator in accordance with claim 18 wherein the resilient elements are springs.

* * * * *